United States Patent [19]

Pessier et al.

[11] 4,441,566

[45] Apr. 10, 1984

[54] DRILL BIT WITH DISPERSED CUTTER INSERTS

[75] Inventors: Rudolf C. O. Pessier, West University Place; Rodolfo M. Ippolito, Euless; Billy E. Baker, Houston, all of Tex.

[73] Assignee: Hughes Tool Company, Houston, Tex.

[21] Appl. No.: 406,592

[22] Filed: Aug. 9, 1982

Related U.S. Application Data

[63] Continuation of Ser. No. 161,977, Jun. 23, 1980, abandoned.

[51] Int. Cl.[3] ..... E21B 10/52

[52] U.S. Cl. ..... 175/374; 175/410

[58] Field of Search ..... 175/374, 375, 377, 378, 175/410, 329, 330

[56] References Cited

U.S. PATENT DOCUMENTS

| | | | |
|---|---|---|---|
| 2,230,569 | 2/1941 | Howard et al. | 175/378 |
| 2,626,128 | 1/1953 | Boice | 175/374 |
| 2,774,571 | 12/1956 | Morlan | 175/374 |
| 3,726,350 | 4/1973 | Pessier | 175/374 |
| 4,187,922 | 2/1980 | Phelps | 175/374 |
| 4,248,314 | 2/1981 | Cunningham et al. | 175/378 X |

*Primary Examiner*—Ernest R. Purser

*Attorney, Agent, or Firm*—Robert A. Felsman; James E. Bradley

[57] ABSTRACT

An earth boring drill bit has hard metal inserts in its cutter shells that are spaced to eliminate rows. Each insert has a surrounding boundary zone with inner and outer loops corresponding to the minimum and maximum desired distances between centerlines of inserts, respectively. Each insert has at least one insert located randomly in its boundary zone. In selecting the locations, a first insert is arbitrarily located. The location of a second insert is randomly selected within the boundary zone of the first insert. The location of a third insert is randomly located within the boundary zone of the second insert, so long as it does not come any closer to the first insert than the minimum desired distance between inserts. Each succeeding insert is chosen in this manner.

8 Claims, 8 Drawing Figures

DRILL BIT WITH DISPERSED CUTTER INSERTS

This is a continuation of application Ser. No. 06/161,977, 06/23/80 and now abandoned.

BACKGROUND OF THE INVENTION

1. Field of the Invention

This invention relates in general to earth boring drill bits, and in particular to the arrangement of the cutting elements.

2. Description of the Prior Art

The most common type of earth boring drill bits for oil and gas wells are cutters that rotate about an axis and roll around the bottom in a path or kerf as the bit rotates. The cutters have rows of teeth that disintegrate the earth formation through force applied on the cutter. The teeth are spaced in rows and spaced to disintegrate as much of the bottom as possible in a single rotation. The prior art earth drilling bits include various features designed to avoid a problem known as "tracking". This problem arises when the spacing of the teeth on a rotatable cutter enables the teeth to fall repetitively within previous tooth impressions in the earth. Eventually, ridges and peaks are formed in the earth, and as a result, the cutter experiences accelerated abrasive wear. The teeth are thus worn prematurely and unevenly. In bits with teeth of hard metal inserts retained by interference fit in drilled holes, the supporting metal may wear prematurely and the inserts may be lost.

Solutions to tracking are shown in U.S. Pat. No. 3,726,350, R.C.O. Pessier, Apr. 10, 1973, and in U.S. patent application Ser. No. 043,533, R.C.O. Pessier, filed May 29, 1979 now U.S. Pat. No. 4,316,515, issued Feb. 23, 1982 . Another solution is suggested in U.S. Pat. No. 4,187,922, F.E. Phelps, Feb. 12, 1980

In each of the above inventions, the inserts are arranged in circumferential rows, with varying spacing among inserts to prevent tracking. These prior art inserts are arranged in groups, with similar spacing in a group, but differing spacing in other groups; or the spacing in each row progresses from a minimum to a maximum and back to the minimum; or the insert spacing is varied in each row so that each pair of inserts is separated by a space different from the space between all other pairs of inserts in the row.

In each of the prior art solutions discussed above, the inserts are arranged in circumferential rows. The rows are separated by a minimum spacing to provide adequate supporting metal for the inserts. To prevent the generation of a ridge between rows, another cutter positioned in the same kerf or path may have staggered rows arranged to remove the earth where such ridges would otherwise form. Another method is to stagger the cutter itself from the other cutter in the kerf, such as shown in U.S. patent application Ser. No. 043,533, R.C.O. Pessier, filed May 29, 1979 now U.S. Pat. No. 4,316,515, issued Feb. 23, 1982. Occasionally, bits sometimes rotate "off-center", meaning that the rotational axis of the bit becomes displaced during drilling from the central axis of the borehole. One result of this phenomenon is the generation of ridges, even between staggered rows of the various cutters.

There are regions of prior art cutters which have annular rows that overlap without intervening spaces. In U.S. Pat. No. 3,726,350, the cutter has half rows offset from each other. E. A. Morlan disclosed in U.S. Pat. No. 2,774,571, Dec. 18,. 1956, the use of an inner end or "nose" of each cutter which has such an arrangement. J. H. Howard et al disclosed in U.S. Pat. No. 2,230.569, Feb. 4, 1941, a large number of arrangements for cutters with milled teeth, including helical rows of teeth. Also, shaft cutters with helical rows have been used in the prior art.

In all art known to applicant, the teeth or inserts are arranged in rows. The rows may be circumferential and perpendicular to the cutter axis, or the inserts in the row may only extend partially around the cutter. The rows may be parallel with the cutter axis, or the rows may be helical as mentioned. All of the various arrangements, however, cannot completely eliminate tracking and provide full coverage in a single kerf with a single cutter.

SUMMARY OF THE INVENTION

The object of this invention is to provide a drill bit for earth boring with cutters having inserts dispersed over the cutter surface such that only one cutter may be used in a selected kerf, and providing more efficient rock fragmentation and balanced wear on the cutting elements.

Another object is to avoid tracking and eliminate the generation of annular ridges, even during off-center running.

These objects are achieved in the preferred embodiment by spacing the inserts in a dispersed pattern that eliminates rows and achieves widely varied spacing. To provide adequate strength of the metal supporting the inserts, a minimum distance is established around each insert as one constraint on the insert spacing. To achieve an interaction between adjacent impressions on the borehole bottom, a maximum distance is established around each insert. The maximum distance is a function of the rock properties and the size of the inserts. Thus, a boundary zone is established around each insert and in these zones the inserts are dispersed.

In choosing the location of the inserts in the preferred method, first an insert is arbitrarily located at any point within the selected region of the cutter shell. Then the location of the second insert is selected within the boundary zone surrounding the first insert by using in the preferred method a random number generator. The third insert is located in the same manner within the boundary zone surrounding the second insert. However, the third insert may not be located closer to the first insert than the desired minimum distance between inserts. The location of each succeeding insert is chosen in the same manner.

DESCRIPTION OF THE PREFERRED EMBODIMENT

Figure 1:
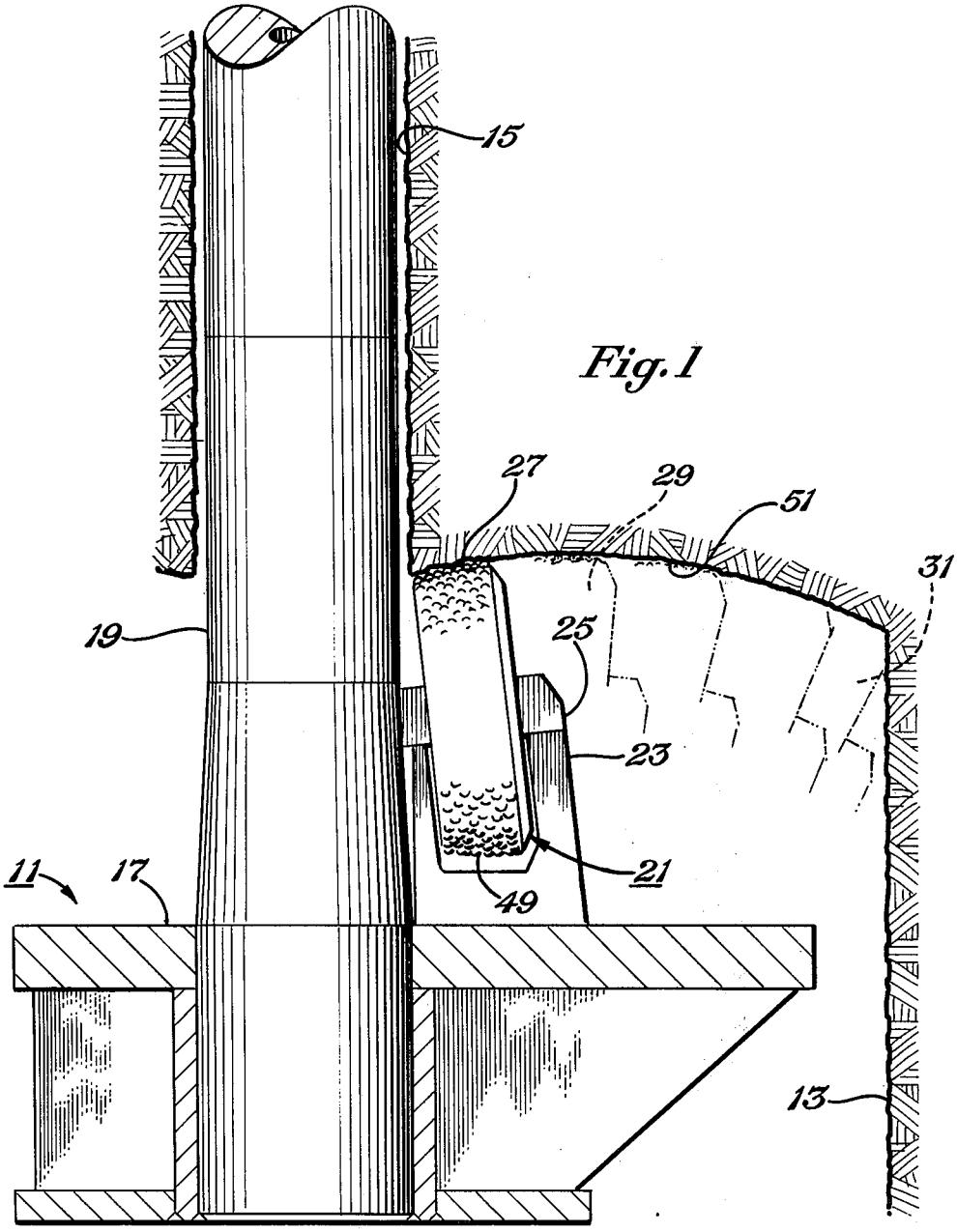
FIG.1 is a frontal view partially in selection of a raise drill reamer, having cutter assemblies constructed in accordance with this invention and shown in phantom as being rotated into the plane of the section to illustrate relative radial positions.

Referring to FIG. 1, a raise drill bit or reamer 11 is shown boring a shaft 13, being drawn upward through a previously drilled pilot hole 15. Raise drill reamer 11 includes a cutter support member or plate 17 secured to be normal to a cylindrical stem 19. Stem 19 is secured to drill pipe (not shown) and has a longitudinal or rotational axis concentric with that of plate 17.

A plurality of cutter assemblies 21 are mounted to the plate 17 by cutter mounts 23. Each cutter mount 23 has two arms 25 spaced apart from each other and facing away from the cutter support plate 17. Arms 25 define a saddle or cradle for receiving a cutter assembly 21.

Cutter assemblies 21 include an inner cutter 27, several intermediate cutters 29, and several outer or gage cutters 31. Inner cutters 27 and the gage cutters 31 are preferably identical. Also, the cutting structure of the inner cutters 27 and of the gage cutters 31 in the preferred embodiment is less than the width of the cutting structure of the intermediate cutters 29.

Each cutter assembly 21 comprises a cutter shell mounted on a bearing, such as shown in U.S. Patent Application Ser. No. 043,533, R.C.O. Pessier, filed May 29, 1979 now U.S. Pat. No. 4,316,515, issued Feb. 23, 1982. The cutter shell 33 for the intermediate cutters 29 is shown in section in FIG. 4. Each cutter shell 33 is generally conical and truncated perpendicular to rotational axis 35 to form a frusto-conical outer surface in rolling contact with the earth. The inner side 37 of the cutter shell 33 is closer to stem 19 (FIG. 1) and is smaller in outer diameter than the outer side 39.

Each cutter shell 33 has a nose region, an intermediate region, and a gage region. Nose region 41 is an annular frusto-conical surface formed at the edge of inner side 37. The surface of nose region 41 is formed at an angle of fifty-four degrees with respect to axis 35. Gage region 43 is a frusto-conical surface formed at the edge of outer side 39. The surface of gage region 43 is formed at an angle of sixty degrees with repect to axis 35. The intermediate region 45 includes an annular section 45*a* next to gage region 43 that is cylindrical and parallel with axis 35. A frusto-conical surface 45*b* joins surface 45*a*, it being formed at seven and one-half degrees with respect to axis 35 in the preferred embodiment. Another frusto-conical surface 45*c*, between surface 45*b* and nose region 41, is formed at a twelve and one-half degree angle with respect to axis 35. Nose and gage regions are defined herein to refer to surfaces immediately joining the inner side and outer sides, respectively, separated by the intermediate region and formed at substantially greater angles with respect to the axis of rotation than the intermediate region.

Figure 2:
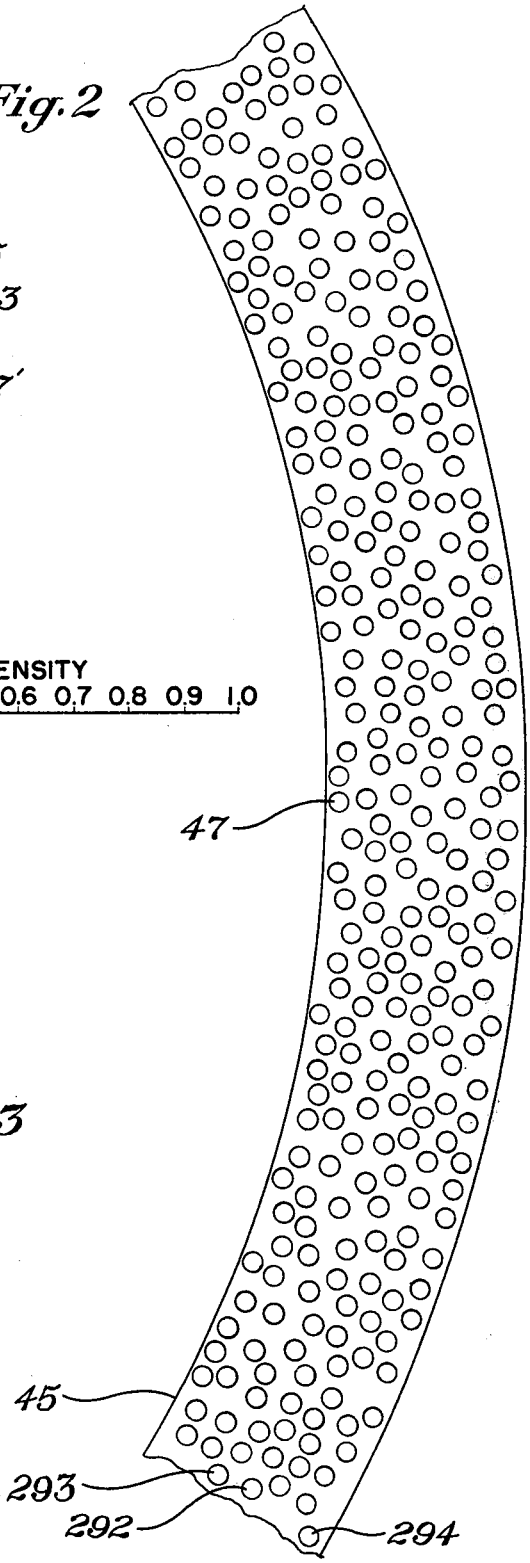
FIG. 2 is a schematic illustrating the insert positions of one of the intermediate cutters of FIG. 1.

Intermediate region 45 contains a plurality of holes 47 (only one shown) drilled normal to its surface for containing hard metal inserts 49 (FIG. 1), preferably constructed from sintered tungsten carbide. In the preferred embodiment for intermediate cutters 29, there are no inserts located in the nose region 41 or heel region 43. The bottom hole pattern of the insert holes 47 is shown schematically in FIG. 2, which represents the appearance of the bottom of the borehole if one cutter is rolled for one revolution. The left side of the drawing of FIG. 2 represents the inner side of the intermediate region 45, at the intersection of surface 45*c* with the nose region 41. The right side of the drawing of FIG. 2 represents the outer side of the intermediate region 45, at the intersection of surface 45*a* with gage region 43.

The inserts in the intermediate region 45 are dispersed or irregularly located within the limits of boundary zones so as to eliminate circumferential rows. Each insert hole 47 in the intermediate region 45 has a boundary zone that surrounds the insert. The boundary zone for a first selected hole 47′ is shown schematically with dashed lines in FIG. 5 and consists of a first loop 53 corresponding to the minimum desired distance between centerlines of inserts, and a second loop 55 corresponding to the maximum desired distance between the centerlines of inserts. In the preferred method and apparatus, the boundary zone loops 53, 55 are concentric circles and identical for each insert hole 47 located in the intermediate region 45.

The minimum distance is empirically determined by the necessary cutter shell metal needed to retain an insert. The maximum distance is determined by the extent a typical earth formation is disturbed by a single insert. These minimum and maximum distances between centerlines will also depend upon the cutter circumference, the insert shape and size, and the amount the insert protrudes from the cutter shell. In the preferred embodiment, for a cutter diameter of 13.496 inch at the inner side of intermediate region 45*c*, a diameter of 15.540 inch at the intermediate surface 45*a*, a hole 47 diameter of 0.6250 inch, and hole 47 depth of 0.500 inch, the minimum spacing between centerlines of inserts is 0.800 inch. Thus the radius of loop 53 is 0.800 inch. The maximum spacing between centerlines of inserts is 1.350 inch for this cutter. Thus the radius of loop 55 is 1.350 inch.

In the preferred method of selecting the location of the inserts, the location of the first hole 47′ is arbitrarily selected at any point in the intermediate region 45. Then, referring to the example of FIG. 5, the location of the centerline of a second hole 47″ is randomly selected within the boundary zone loops 53 and 55 of the first hole 47′ as determined by a typical computer resident random number generator. The word "random"refers generally to an irregular selection that has no specific pattern within the specified boundary zones.

Figure 5:
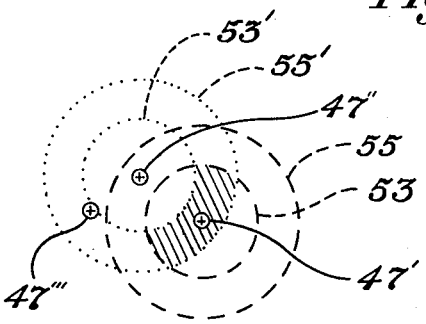
FIG. 5 is a schematic illustration of a method of locating inserts in accordance with this invention.

Boundary zone inner loops 53′ and 55′ are then applied around the centerline of the second insert 47″, as indicated by the dotted lines in FIG. 5. The centerline of third hole 47‴ is randomly located within the boundary zone of the second hole 47″. However, the third hole 47‴ may not be located closer to the first insert hole 47′ than the desired minimum distance between inserts. The portion of the boundary zone of the second hole 47″ that is too close to the first hole 47′ is indicated by the cross-hatched lines. This procedure is carried out with each succeeding insert location being randomly chosen within the boundary zone of the preceding insert, but not closer to any previously selected insert than the desired minimum spacing between inserts. The procedure is repeated until the intermediate region is completely covered. Because of the space limits of the intermediate region, there will be a few spaces that are greater than the desired maximum distance from inserts, but yet provide insufficient space to place an additional insert without being too close to an existing insert. The minimum distance must always be observed.

The selection process can be performed manually or by a computer. In the computer method, a random number generator is used to select the locations within boundary zone limits. In a pure mathematical sense, the program is not random since in a true random selection, repeats will occur. The random number generator used with the program will generate approximately 50,000 numbers before repeating a number. This is sometimes called pseudorandom selection. In the program, the intermediate region 45 was assumed to be a single angle conical surface, rather than having multiple angles in the sections 45*a*, 45*b* and 45*c*.

In selecting locations, certain of the insert holes 47 will fall close to the edge of the intermediate region 45. This is permissible so long as the cylindrical surface of the hole 47 is no closer than about 1/64 inch from an edge of intermediate region 45. If the boundary zone of a preceding insert falls across an edge of the intermediate region 45, only the portion of the boundary zone inside the intermediate region may be used to locate an insert.

Figure 3:
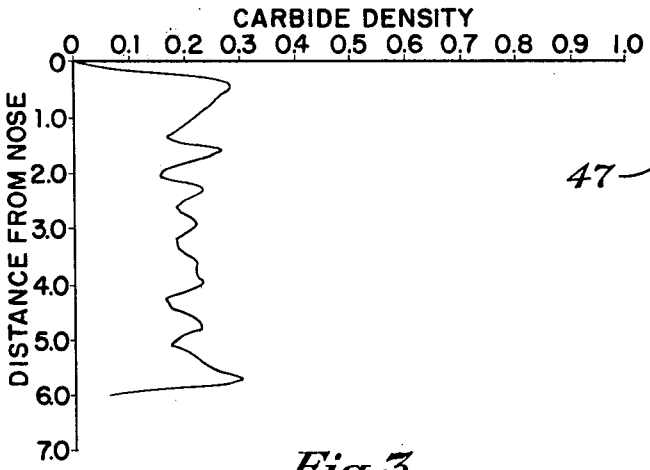
FIG. 3 is a graph indicating the insert density of one of the intermediate cutters of FIG. 1.

The result is a cutter with an intermediate region 45 wherein rows are deliberately avoided. Preferably the spacing is dispersed such that there are no groups of three adjacent inserts wherein a single plane can be passed through the points where their centerlines intersect the cutter surface. While it is possible for one or more groups to occur in the preferred method, such occurrence is expected to be rare. FIG. 3 is a graph indicating the approximate uniformity of coverage of the cutting structure. This graph has been prepared by starting at the nose region 41 and making a plot of the relative insert density as one proceeds outward to the gage region 43. The relative density represents the approximate total linear distance of inserts through which a selected plane passes, divided by the associated circumference of the cutter shell at the selected plane. The selected plane must be perpendicular to the axis 35 of the cutter shell 33. For example, a plane passing through the intermediate region 45*c* about one-half inch from nose region 41 and perpendicular to axis 35 would pass through a number of inserts 49. The plane might pass through and bisect some inserts while passing through only a segment of other inserts. The distance that the plane cuts through each insert at a point flush with the cutter shell 33 is added. When summed, these distances divided by the associated circumference yields about 0.28 at a point one-half inch from nose region 41. If the inserts were spaced in a circumferential row at this point, and had no cutter metal between them, then the relative density would be 1.0 or 100%.

Note that the coverage is fairly uniform, in that once past the first one quarter inch or so at both edges of the intermediate region 45, the density varies between about 0.15 and 0.28, and preferably does not drop below 0.10. This indicates that all possible planes passing perpendicular through the axis 35 will pass through a portion of at least one insert. If there werre circumferential rows, then the graph of FIG. 3 would register zeros between the rows, since the planes at these points would fail to pass through any inserts.

Table No. 1, attached, lists the precise location of each insert 49 in the insert holes 47 in the intermediate region 45 for a cutter having dimensions described above. The column marked "A" represents the distance along the axis 35 from the outer side 39 to the point where the insert is located. The angle $\alpha$ is a radial measurement of the cutter shell 33 about its axis 35, beginning with an arbitrary first point. The difference between any of the angles $\alpha$ is proportional to the circumferential distance along the cutter's intermediate region 45 is a plane perpendicular to the axis 35. Although not necessary to the invention, note that, to three decimal points, each insert hole 47 is located at a different distance from the outer side 39 than all others. Also, each insert hole 47, to three decimal points, is located on a different radial plane than all other insert holes.

The insert locations were not selected by the computer in the numerical order shown in the table. That is, second insert location chosen by the computer is not necessarily the insert number 2 in the table. Insert number 3 in the table is not within the boundary zone of insert number 2 in the table. Rather the table conveniently lists the inserts by increasing angle $\alpha$. The inserts numbered 292 through 294 are indicated in FIG. 3 to correlate FIG. 3 with the table. All of the insert holes 47 are drilled normal to the surface that they are located on, except for holes that fall across the intersection of intermediate region 45*a* with the intermediate region 45*b*, and the intersection of intermediate region 45*b* with intermediate region 45*c*. With these holes, the hole is drilled normal to the surface that contains more than half of the diameter of the hole.

Figure 6:
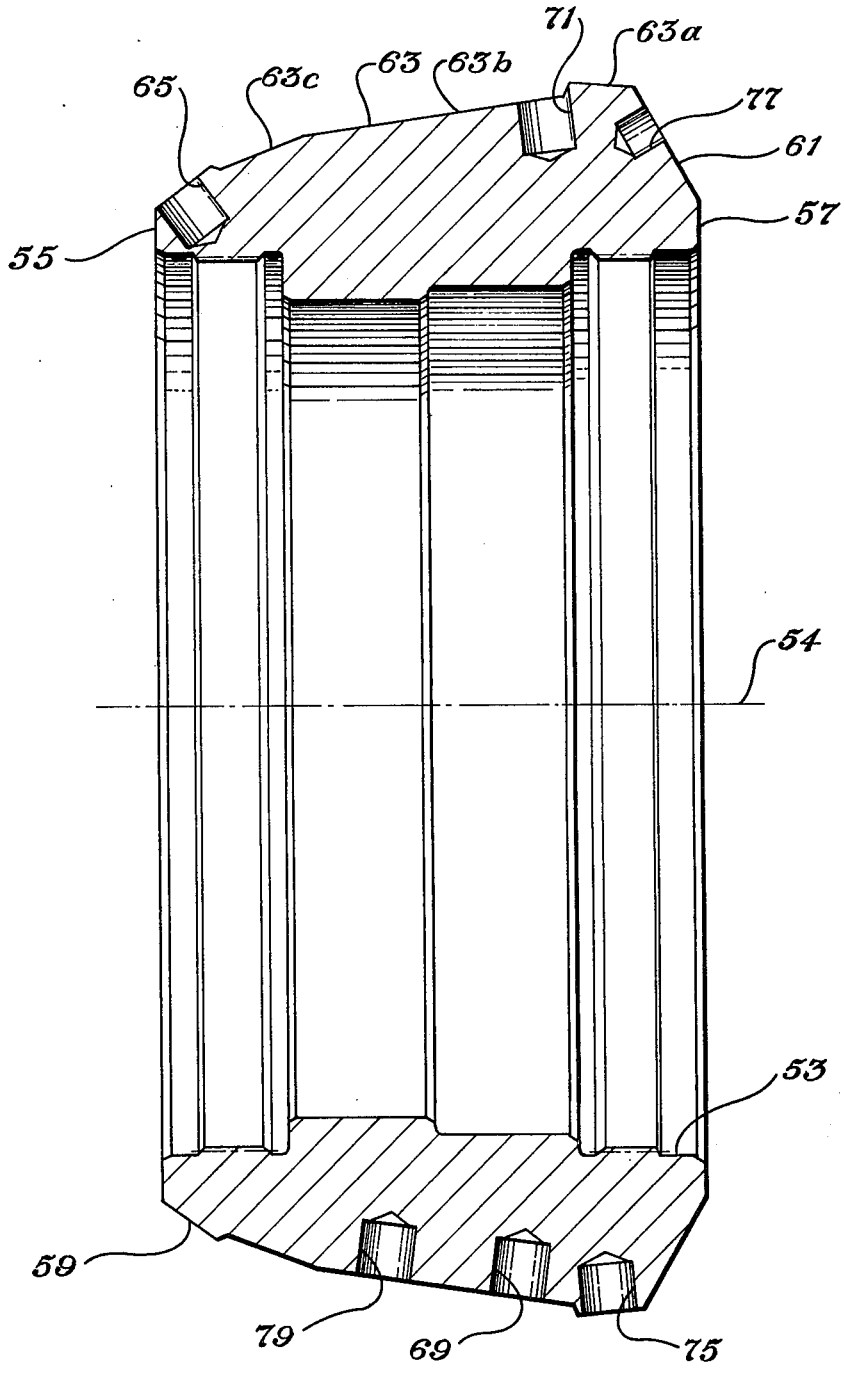
FIG. 6 is a sectional view of a cutter shell for one of the inner cutters or gage cutters.

FIG. 6 discloses a sectional view of an inner cutter 27 or a gage cutter 31 (FIG. 1), these cutters being identical to each other but considerably different from the intermediate cutters 29. One reason is that the gage cutter 23 needs an extra high density of inserts on its outer edge for cutting the sidewall of the shaft 13. Also, the inner cutter 23 needs a row of inserts on its nose region for cutting the edge of the pilot hole 15. For interchangeability, the inner cutter 27 and gage cutter 31 are made identical to each other, with rows of inserts being located both on the nose region and near the heel region.

The inner cutter 27 or gage cutter 31 comprises a cutter shell 53 that is generally conical and truncated perpendicular to its rotational axis 54. The bearings for the cutter shell 53 are of the same structure as used with intermediate cuttters 29. Cutter shell 53 has an inner side 55 that is closer to stem 19 (FIG. 1) than its outer side 57. Each cutter shell 53 has a nose region, an intermediate region, and a gage region, as previously defined in connection with intermediate cutters 29. Nose region 59 is an annular frusto-conical surface formed at the edge of inner side 55 at an angle of thirty-five degrees with respect to the axis 54. Gage region 61 is an annular frusto-conical surface formed at the edge of outer side 57 at an angle of sixty degrees with respect to axis 54. The intermediate region 63 includes an annular section 63*a* next to gage region 61 that is formed at an angle of five degrees with respect to axis 54. A frusto-conical surface 63*b* joins surface 63*a* and is formed at an angle of seven and one-half degrees with respect to axis 54. Another frusto-conical surface 63*c*, between nose region 59 and surface 63*b*, is formed at an angle of twenty degrees with respect to axis 54.

Nose region 59 contains a row 65 of holes drilled and reamed for inserts 49 (FIG. 1). Row 65 contains thirty-seven holes, all spaced the same distance from the outer side 57. The pitch is defined herein to be the distance between centerlines of the inserts at the shell 53 surface. The pitch is varied in row 65 to avoid tracking in accordance with the teachings in U.S. patent application, Ser.

Figure 7:
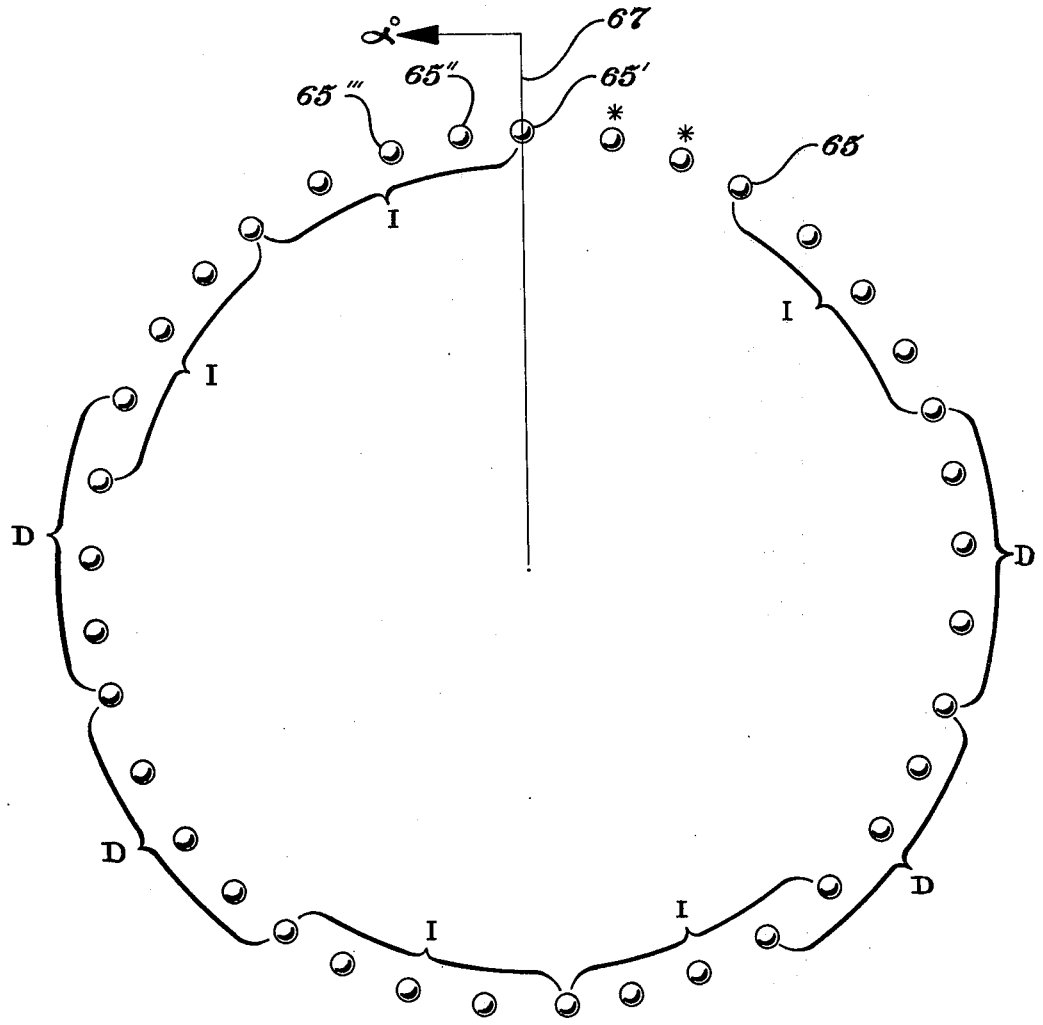
FIG. 7 is a schematic layout of one of the rows of inserts in one of the gage cutters or inner cutters of FIG. 1.

No. 043,533, R. C. O. Pessier, filed May 29, 1979 now U.S. Pat. No 4,316,515, issued Feb. 23, 1982. Referring to FIG. 7, row 65 is divided into groups of increasing pitch, marked "I"and decreasing pitch, marked "D", in a counterclockwise direction. The pitch gradually increases in the increasing groups and gradually descreases in the decreasing groups. The inserts marked with an asterisk fill in the space between the last insert in the last group in row 65 and the first insert in the first group.

The amount of increase in pitch, decrease in pitch and the number in each group are selected according to several criteria. First, there is a minimum pitch determined by the necessary cutter shell metal needed to hold the insert in place. The maximum amount of pitch is determined by the extent a typical earth formation is disturbed by a single insert. This will be greater than the diameter of the insert 49 and depends also on the cutter shell 53 circumference, and the size, shape and amount the insert protrudes from the cutter shell exterior.

The number of inserts within the group depends upon the desired change from insert to insert. To have an appreciable difference between the pitch from one insert to its adjacent inserts, generally groups from about three to seven inserts are used. To calculate the precise position, the number of spaces between inserts in the group, less one, is divided into the total increase in pitch. This constant number is allotted to each space between inserts in the group. Consequently, in an increasing group, any space between insert centerlines will be the same as the preceding space in the group plus the constant number. In a decreasing group, any space between insert centerlines will be the same as the preceding space less the constant number. Preferably the same maximum and minimum are used for each group within a single row.

Referring still to FIG. 7, row 65 has nine insert groups, five increasing and four decreasing. Two increasing groups are followed by two decreasing groups respectively. Each group contains five inserts, yielding four spaces between inserts in each group for varying pitch. Also, when an increasing group is followed by a decreasing group, the groups overlap with the last space of the increasing group being also the first space of the decreasing group.

Figure 4:
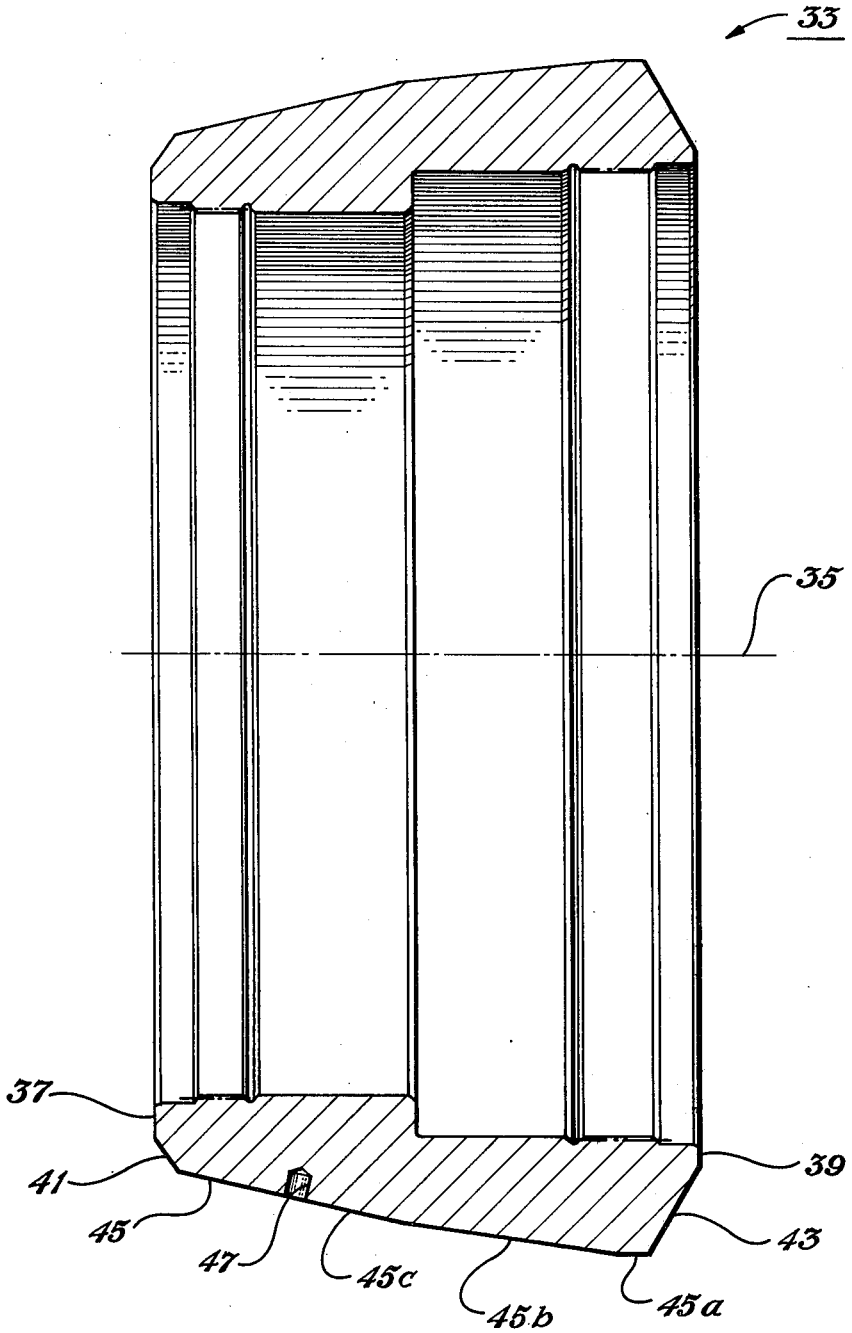
FIG. 4 is a sectional view of a cutter shell for one of the intermediate cutters of FIG. 1.

FIG. 7 discloses the relative angular positions of the inserts in row 65, as indicated in the Table No. 2, set forth subsequently. Cutter shell 53 (FIG. 6) uses the same size of inserts 49 (FIG. 4) as cutter shell 33 (FIG. 4). However, it has different dimensions, it being 5.500 inches from inner side 55 to outer side 57, 15.601 inches in diameter at the inner edge of the gage region 61 and 14.262 inches in diameter at the outer edge of the nose region 59. The angle $\alpha$ in FIG. 7 begins at zero with the vertical axis 67. The insert hole 65' located on the axis 67 is indicated in this table as insert no. 2, all of the inserts in row 65 for this particular cutter size being 5.219 inches from the outer side 57 as shown in the "A" column. The next insert hole 65" in row 65 is insert No. 7 in Table No. 2, located 8.560 degrees rotationally from the centerline of the first insert hole 65' and from axis 67. The third insert hole 65''' is insert no. 13 in Table No. 2, located 17.940 degrees from axis 67 or 9.430 degrees from the centerline of insert hole 65".

The gradual increase and decrease in pitch and the insert locations can be determined through Table No. 2 in this manner. The other numbers listed in Table No. 2 disclose locations for other inserts on cutter shell 53, discussed subsequently.

Figure 8:
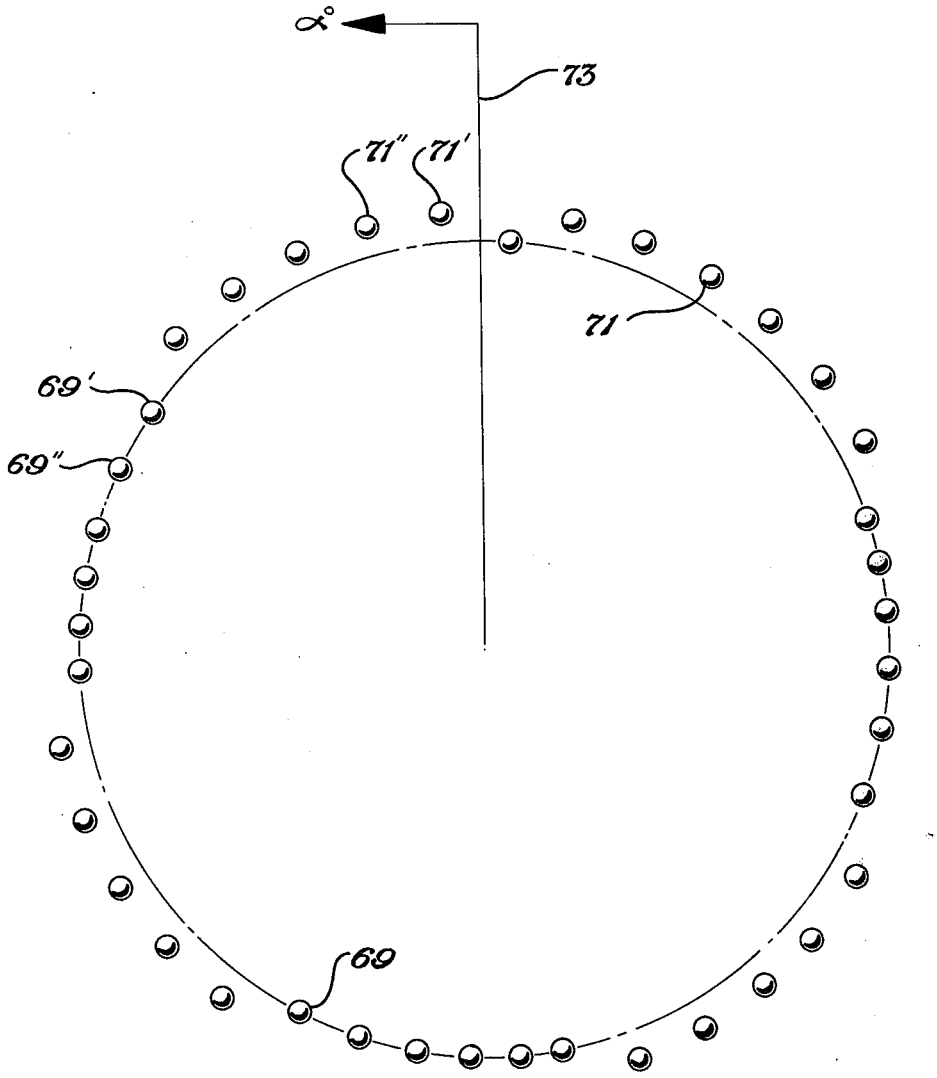
FIG. 8 is a schematic layout of two of the rows of inserts in one of the gage cutters or inner cutters of FIG. 1.

Referring again to FIG. 6, a staggered row 69 of inserts is located in the intermediate region section **63*b* near the edge with intermediate section 63*a*. FIG. 8 is a layout similar to FIG. 7, disclosing the relative positions of rows 69 and 71. All of the insert centerlines of row 69 are located 1.874 inches from the outer side 57 while all of the insert centerlines of row 71 are located 1.581 inches from outer side 57. The centerlines are thus 0.293 inches apart when measured along the axis 54. Since the diameter of the holes for these inserts is 0.625 inches, there will be overlapping coverage of approximately one-half the insert's diameter. To assure some overlapping the axial distance between row 69 and 71** insert centerlines should not exceed the insert diameter.

The eighteen inserts of row 69 are divided into three groups of six inserts each. Each group of row 69 is a decreasing pitch group, when considered counterclockwise. The positioning of these inserts is selected as set forth in the dicussion of row 65 and is set forth in Table No. 2. Each group of row 69 alternates and is circumferentially separated by a group of inserts from row 71. The first insert hole 69' of row 69 is listed as insert number 38 in Table No. 2, and is located 54.290 degrees from axis 73, which is the same axis as axis 67. The second insert hole 69" is listed as insert no. 46 as is located 63.430 degrees from axis 73.

The twenty-one insert holes of row 71 are divided into four groups, three of which have five inserts and one has six inserts. The groups of row 71 have uniform pitch between inserts. The first insert hole 71' of row 71 is listed in Table No. 2 as insert no. 5, located 4.940 degrees from axis 73. The second insert hole 71" of row 71 is listed in Table No. 2 as insert no. 12, located 14.810 degrees from axis 73.

Referring again to FIG. 6, a fourth row 75 of inserts is located in the intermediate section **63*a*. The centerlines of all of insert holes of row 75 are spaced 1.015 inches from the outer side 57. There are forty insert holes in row 75 and they are divided into three increasing groups of seven inserts each or six spaces between inserts. The pitch of these groups is calculated as set forth in the discussion of row 65. Inserts are equally spaced between these three groups. The precise positions are shown in Table No. 2, with all row 75** insert holes being found in the "A" column under the distance 1.015 inches.

Note, that for an insert of 0.625 diameter, the coverage of heel row 75 overlaps with the inserts of the staggered row 71 since they are only 0.566 axial inches apart. To allow this overlap, each insert of staggered row 71 is spaced between two inserts of heel row 75. The overlap prevents buildup between the heel row 75 and staggered row 71.

Referring to FIG. 6, a gage row 77 of gage inserts is located in the gage region 61. The gage inserts (not shown), differ from inserts 49 (FIG. 1) in that they have flat top surfaces. The gage inserts are mounted with their top surfaces flush with the gage region 61. Preferably there are thirty-nine equally spaced inserts in row 77, and these inserts are not listed in Table No. 2.

Referring to FIG. 6, a plurality of holes 79 (only one shown) are dispersed in the intermediate region sectons **63*b* and 63*c*. The locations for holes 79 are selected in the region between the nose region 59 and boundary zones of rows 69 and 71. Holes 79 are selected within the same maximum and minimum limits for the boundary zone as discussed in connection with the intermediate cutter 29. The same computer program as prevously set forth is used for selecting the locations of holes 79, with different numbers used for the dimensions of the intermediate region. The locations of all of the randomly selected inserts in the cutter shell 53** are set forth in Table No. 2.

Because of the irregular boundary provided by rows 69 and 71, there will be no circumferential space between rows 69 and 71 and the dispersed holes 79. That is, any plane passing perpendicular to the axis 54 in the intermediate region 63 will necessarily cut through a portion of at least one insert. Since the staggered rows 69 and 71 prevent any circumferential spaces to exist between these rows and heel row 75, there will be no spaces in the intermediate region 63 through which a perpendicular plane could pass without striking a portion of at least one insert. A circumferential space does exist in the nose region 59, inward from the nose row 65. The relative density of inserts across the cutter shell 53 is fairly uniform, and preferably does not drop below 0.10, as previously defined in connection with cutter shell 33.

In operation, stem 19 (FIG. 1) is rotated clockwise and urged upward. This causes cutter assemblies 21 to rotate, creating an annular path about the borehole face 51. The inserts 49 disintegrate the earth, creating shaft 13.

The invention has significant advantages. In the intermediate portion of the borehole, between the gage and inner cutters, only one cutter is required to cover an annular section of the borehole face, since the insert positioning does not allow ridge buildup that might otherwise occur in the prior art between rows. Without the need for overlapping or staggering cutters, greater pressure can be exerted through the inserts, since there will be fewer cutters for transmitting the force imposed on the bit. Fewer cutters reduce maintenance required in shaft drilling. The shaft face is evenly covered, providing efficient fragmentation and avoiding uncut bottom due to off-center running conditions. Since overlapping cutters are not required in the intermediate portion, tracking between cutters is avoided.

The combination of the dispersed pattern with rows of inserts with varying pitch for the gage and inner cutters evenly covers the borehole face. The rows provide higher carbide density for the pilot hole and sidewall areas of the borehole. The varying pitch in these rows avoids tracking.

While the invention has been shown in only one of its forms, it should be apparent that it is not so limited, but is susceptible to various modifications and changes without departing from the spirit thereof.

TABLE NO. 1

| Insert No. | α | A |
|---|---|---|
| 1 | 1.727 | 6.274 |
| 2 | 1.987 | 5.246 |
| 3 | 2.568 | 2.055 |
| 4 | 6.542 | 3.221 |
| 5 | 8.099 | 3.991 |
| 6 | 8.254 | 1.416 |
| 7 | 8.261 | 2.335 |
| 8 | 10.850 | 5.665 |
| 9 | 11.505 | 4.838 |
| 10 | 12.788 | 6.422 |
| 11 | 13.931 | 2.797 |
| 12 | 14.310 | 3.623 |
| 13 | 14.507 | 1.931 |

TABLE NO. 1-continued

| Insert No. | α | A |
|---|---|---|
| 14 | 16.892 | 5.324 |
| 15 | 17.411 | 1.166 |
| 16 | 19.184 | 6.289 |
| 17 | 19.422 | 4.576 |
| 18 | 22.170 | 2.864 |
| 19 | 22.964 | 1.708 |
| 20 | 25.827 | 3.950 |
| 21 | 25.870 | 5.887 |
| 22 | 29.928 | 3.217 |
| 23 | 30.198 | 5.006 |
| 24 | 30.652 | 2.412 |
| 25 | 32.184 | 1.456 |
| 26 | 32.245 | 6.426 |
| 27 | 32.505 | 4.111 |
| 28 | 35.900 | 2.785 |
| 29 | 35.982 | 5.611 |
| 30 | 37.475 | 3.633 |
| 31 | 37.591 | 1.849 |
| 32 | 38.839 | 1.072 |
| 33 | 39.066 | 4.410 |
| 34 | 41.853 | 2.803 |
| 35 | 42.694 | 6.197 |
| 36 | 43.273 | 5.232 |
| 37 | 46.443 | 1.631 |
| 38 | 47.350 | 3.864 |
| 39 | 48.839 | 5.651 |
| 40 | 50.406 | 6.447 |
| 41 | 51.185 | 2.867 |
| 42 | 51.707 | 1.097 |
| 43 | 53.379 | 5.047 |
| 44 | 54.072 | 1.857 |
| 45 | 54.759 | 3.921 |
| 46 | 56.250 | 6.045 |
| 47 | 58.974 | 4.601 |
| 48 | 59.969 | 1.337 |
| 49 | 60.701 | 2.856 |
| 50 | 61.889 | 5.506 |
| 51 | 62.026 | 6.447 |
| 52 | 62.996 | 2.081 |
| 53 | 63.630 | 3.804 |
| 54 | 67.607 | 1.288 |
| 55 | 69.053 | 3.368 |
| 56 | 69.584 | 5.987 |
| 57 | 70.115 | 4.702 |
| 58 | 71.737 | 2.096 |
| 59 | 75.719 | 1.434 |
| 60 | 76.024 | 4.161 |
| 61 | 76.074 | 5.800 |
| 62 | 77.241 | 2.835 |
| 63 | 77.490 | 5.028 |
| 64 | 80.430 | 6.463 |
| 65 | 80.569 | 2.127 |
| 66 | 81.065 | 1.063 |
| 67 | 81.253 | 3.445 |
| 68 | 82.048 | 4.429 |
| 69 | 84.761 | 5.710 |
| 70 | 87.510 | 1.389 |
| 71 | 87.637 | 4.888 |
| 72 | 87.891 | 2.527 |
| 73 | 89.070 | 4.117 |
| 74 | 90.031 | 3.274 |
| 75 | 92.552 | 6.294 |
| 76 | 92.935 | 1.041 |
| 77 | 93.014 | 5.365 |
| 78 | 95.556 | 1.994 |
| 79 | 95.956 | 4.426 |
| 80 | 96.207 | 2.922 |
| 81 | 99.536 | 6.298 |
| 82 | 99.764 | 5.391 |
| 83 | 101.904 | 1.191 |
| 84 | 102.276 | 2.039 |
| 85 | 103.432 | 3.557 |
| 86 | 104.270 | 4.588 |
| 87 | 108.129 | 3.023 |
| 88 | 108.255 | 1.701 |
| 89 | 108.354 | 5.835 |
| 90 | 111.146 | 3.968 |
| 91 | 112.865 | 5.025 |
| 92 | 113.454 | 6.424 |
| 93 | 114.497 | 2.999 |

TABLE NO. 1-continued

| Insert No. | α | A |
|---|---|---|
| 94 | 116.327 | 2.205 |
| 95 | 116.353 | 1.403 |
| 96 | 117.798 | 4.251 |
| 97 | 118.022 | 5.668 |
| 98 | 121.284 | 3.455 |
| 99 | 121.914 | 4.896 |
| 100 | 122.057 | 1.286 |
| 101 | 123.157 | 6.427 |
| 102 | 125.587 | 2.285 |
| 103 | 126.509 | 4.073 |
| 104 | 128.166 | 5.822 |
| 105 | 128.441 | 1.463 |
| 106 | 131.087 | 3.182 |
| 107 | 131.150 | 4.601 |
| 108 | 133.733 | 6.412 |
| 109 | 134.106 | 1.129 |
| 110 | 134.464 | 5.578 |
| 111 | 135.683 | 2.215 |
| 112 | 136.234 | 3.750 |
| 113 | 138.749 | 4.501 |
| 114 | 139.945 | 3.112 |
| 115 | 141.179 | 1.619 |
| 116 | 142.368 | 5.352 |
| 117 | 142.952 | 6.422 |
| 118 | 144.681 | 3.914 |
| 119 | 145.362 | 2.207 |
| 120 | 148.462 | 1.343 |
| 121 | 148.494 | 3.134 |
| 122 | 150.796 | 5.798 |
| 123 | 151.596 | 4.578 |
| 124 | 151.855 | 2.455 |
| 125 | 154.560 | 3.769 |
| 126 | 154.592 | 1.353 |
| 127 | 157.488 | 6.105 |
| 128 | 157.848 | 3.084 |
| 129 | 158.066 | 4.863 |
| 130 | 160.213 | 1.856 |
| 131 | 160.267 | 1.056 |
| 132 | 160.727 | 3.961 |
| 133 | 164.258 | 5.831 |
| 134 | 164.671 | 4.743 |
| 135 | 166.019 | 1.489 |
| 136 | 166.092 | 2.814 |
| 137 | 168.348 | 3.842 |
| 138 | 170.730 | 5.196 |
| 139 | 173.285 | 2.211 |
| 140 | 173.546 | 3.279 |
| 141 | 173.921 | 6.154 |
| 142 | 174.762 | 4.289 |
| 143 | 175.558 | 1.291 |
| 144 | 177.134 | 5.130 |
| 145 | 179.328 | 2.404 |
| 146 | 179.995 | 6.442 |
| 147 | 180.189 | 3.546 |
| 148 | 181.236 | 1.048 |
| 149 | 184.588 | 4.480 |
| 150 | 184.897 | 1.667 |
| 151 | 185.716 | 5.566 |
| 152 | 186.530 | 6.389 |
| 153 | 187.729 | 2.801 |
| 154 | 189.803 | 3.836 |
| 155 | 192.064 | 5.113 |
| 156 | 192.265 | 1.956 |
| 157 | 192.375 | 1.112 |
| 158 | 195.765 | 5.992 |
| 159 | 195.831 | 3.307 |
| 160 | 196.134 | 4.465 |
| 161 | 198.569 | 5.237 |
| 162 | 199.155 | 1.384 |
| 163 | 199.713 | 2.670 |
| 164 | 202.621 | 4.241 |
| 165 | 204.354 | 1.818 |
| 166 | 204.759 | 6.375 |
| 167 | 207.027 | 3.522 |
| 168 | 207.179 | 5.165 |
| 169 | 208.168 | 2.629 |
| 170 | 208.272 | 1.083 |
| 171 | 211.294 | 6.093 |
| 172 | 213.234 | 3.124 |
| 173 | 213.906 | 5.169 |

TABLE NO. 1-continued

| Insert No. | α | A |
|---|---|---|
| 174 | 213.940 | 3.988 |
| 175 | 213.951 | 1.663 |
| 176 | 216.771 | 2.474 |
| 177 | 219.103 | 1.051 |
| 178 | 219.308 | 4.527 |
| 179 | 219.491 | 5.804 |
| 180 | 220.618 | 3.566 |
| 181 | 221.733 | 1.975 |
| 182 | 225.322 | 5.164 |
| 183 | 225.483 | 4.305 |
| 184 | 226.004 | 2.737 |
| 185 | 227.341 | 6.105 |
| 186 | 228.960 | 1.484 |
| 187 | 229.899 | 3.749 |
| 188 | 230.958 | 4.796 |
| 189 | 232.054 | 1.846 |
| 190 | 233.387 | 2.075 |
| 191 | 233.723 | 5.942 |
| 192 | 236.159 | 4.103 |
| 193 | 236.676 | 1.073 |
| 194 | 237.128 | 3.296 |
| 195 | 237.445 | 5.153 |
| 196 | 240.825 | 2.521 |
| 197 | 241.210 | 6.438 |
| 198 | 241.675 | 1.526 |
| 199 | 243.043 | 5.579 |
| 200 | 243.697 | 3.233 |
| 201 | 244.822 | 4.421 |
| 202 | 247.220 | 2.090 |
| 203 | 248.494 | 6.051 |
| 204 | 249.469 | 3.728 |
| 205 | 249.479 | 5.257 |
| 206 | 251.746 | 1.128 |
| 207 | 254.069 | 2.958 |
| 208 | 254.674 | 4.263 |
| 209 | 255.042 | 6.143 |
| 210 | 256.558 | 1.989 |
| 211 | 256.908 | 5.331 |
| 212 | 259.212 | 3.407 |
| 213 | 259.408 | 1.207 |
| 214 | 260.766 | 2.595 |
| 215 | 261.405 | 5.946 |
| 216 | 261.839 | 4.351 |
| 217 | 265.013 | 1.721 |
| 218 | 266.455 | 2.889 |
| 219 | 266.463 | 6.320 |
| 220 | 268.040 | 6.086 |
| 221 | 268.523 | 1.094 |
| 222 | 269.123 | 3.597 |
| 223 | 270.621 | 2.156 |
| 224 | 271.034 | 4.566 |
| 225 | 275.107 | 1.148 |
| 226 | 275.665 | 3.015 |
| 227 | 277.826 | 5.052 |
| 228 | 277.847 | 6.047 |
| 229 | 279.129 | 2.082 |
| 230 | 279.492 | 3.833 |
| 231 | 281.728 | 1.106 |
| 232 | 283.924 | 3.230 |
| 233 | 284.282 | 6.361 |
| 234 | 286.831 | 5.498 |
| 235 | 286.903 | 4.403 |
| 236 | 288.504 | 2.058 |
| 237 | 291.300 | 1.098 |
| 238 | 291.889 | 2.964 |
| 239 | 292.522 | 5.990 |
| 240 | 294.047 | 5.210 |
| 241 | 294.542 | 2.227 |
| 242 | 295.964 | 3.764 |
| 243 | 298.867 | 1.180 |
| 244 | 300.366 | 4.822 |
| 245 | 300.779 | 5.707 |
| 246 | 301.780 | 2.721 |
| 247 | 303.590 | 1.855 |
| 248 | 303.609 | 3.719 |
| 249 | 305.979 | 1.102 |
| 250 | 307.224 | 6.404 |
| 251 | 308.434 | 5.622 |
| 252 | 308.552 | 3.129 |
| 253 | 308.800 | 4.414 |

TABLE NO. 1-continued

| Insert No. | α | A |
|---|---|---|
| 254 | 309.961 | 2.272 |
| 255 | 312.821 | 1.581 |
| 256 | 315.905 | 3.903 |
| 257 | 316.163 | 3.078 |
| 258 | 317.068 | 5.172 |
| 259 | 317.126 | 6.132 |
| 260 | 318.283 | 2.074 |
| 261 | 318.994 | 1.198 |
| 262 | 322.344 | 2.685 |
| 263 | 323.195 | 4.104 |
| 264 | 324.405 | 1.578 |
| 265 | 325.035 | 6.305 |
| 266 | 327.417 | 5.273 |
| 267 | 327.625 | 3.504 |
| 268 | 329.556 | 1.060 |
| 269 | 329.768 | 2.460 |
| 270 | 331.292 | 4.655 |
| 271 | 331.871 | 6.357 |
| 272 | 333.889 | 1.639 |
| 273 | 335.236 | 3.538 |
| 274 | 335.820 | 2.670 |
| 275 | 336.249 | 5.696 |
| 276 | 337.643 | 4.580 |
| 277 | 338.635 | 6.437 |
| 278 | 339.228 | 1.310 |
| 279 | 341.522 | 3.314 |
| 280 | 341.697 | 2.448 |
| 281 | 344.643 | 4.023 |
| 282 | 346.415 | 5.099 |
| 283 | 346.658 | 1.559 |
| 284 | 347.334 | 6.076 |
| 285 | 347.693 | 2.401 |
| 286 | 348.638 | 3.257 |
| 287 | 351.194 | 4.218 |
| 288 | 353.546 | 2.643 |
| 289 | 353.593 | 5.100 |
| 290 | 354.036 | 5.961 |
| 291 | 354.275 | 1.653 |
| 292 | 357.772 | 3.395 |
| 293 | 358.809 | 4.512 |
| 294 | 359.549 | 1.081 |

TABLE NO. 2

| NO | α° ± .02 | A ± .015 |
|---|---|---|
| 1 | 0.000 | 1.015 |
| 2 | 0.000 | 5.219 |
| 3 | 1.641 | 4.413 |
| 4 | 3.523 | 3.651 |
| 5 | 4.940 | 1.581 |
| 6 | 6.505 | 2.814 |
| 7 | 8.560 | 5.219 |
| 8 | 9.870 | 1.015 |
| 9 | 11.714 | 4.131 |
| 10 | 11.727 | 2.399 |
| 11 | 13.983 | 3.317 |
| 12 | 14.810 | 1.581 |
| 13 | 17.940 | 5.219 |
| 14 | 19.740 | 1.015 |
| 15 | 19.827 | 4.030 |
| 16 | 20.261 | 2.377 |
| 17 | 23.781 | 3.239 |
| 18 | 24.680 | 1.581 |
| 19 | 28.031 | 4.210 |
| 20 | 28.106 | 2.486 |
| 21 | 28.130 | 5.219 |
| 22 | 29.610 | 1.015 |
| 23 | 32.626 | 3.496 |
| 24 | 34.550 | 1.581 |
| 25 | 34.607 | 2.622 |
| 26 | 39.130 | 5.219 |
| 27 | 39.303 | 2.023 |
| 28 | 39.480 | 1.015 |
| 29 | 39.520 | 4.414 |
| 30 | 40.567 | 2.967 |
| 31 | 44.420 | 1.581 |
| 32 | 46.647 | 3.487 |
| 33 | 47.690 | 5.219 |

TABLE NO. 2-continued

| NO | α° ± .02 | A ± .015 |
|---|---|---|
| 34 | 47.838 | 4.271 |
| 35 | 48.943 | 2.653 |
| 36 | 49.350 | 1.015 |
| 37 | 34.084 | 1.046 |
| 38 | 54.290 | 1.874 |
| 39 | 54.905 | 3.057 |
| 40 | 55.570 | 1.015 |
| 41 | 57.070 | 5.219 |
| 42 | 60.251 | 2.720 |
| 43 | 61.524 | 4.408 |
| 44 | 62.520 | 1.015 |
| 45 | 63.112 | 3.632 |
| 46 | 63.430 | 1.874 |
| 47 | 66.885 | 3.011 |
| 48 | 67.260 | 5.219 |
| 49 | 70.200 | 1.015 |
| 50 | 71.692 | 3.819 |
| 51 | 71.840 | 1.874 |
| 52 | 73.313 | 2.809 |
| 53 | 78.260 | 5.219 |
| 54 | 78.375 | 3.230 |
| 55 | 78.610 | 1.015 |
| 56 | 79.520 | 1.874 |
| 57 | 80.372 | 4.125 |
| 58 | 82.533 | 2.643 |
| 59 | 86.470 | 1.874 |
| 60 | 87.629 | 3.684 |
| 61 | 87.750 | 1.015 |
| 62 | 88.450 | 5.219 |
| 63 | 90.068 | 2.805 |
| 64 | 92.690 | 1.874 |
| 65 | 93.839 | 4.370 |
| 66 | 94.454 | 3.510 |
| 67 | 97.620 | 1.015 |
| 68 | 97.830 | 5.219 |
| 69 | 99.950 | 2.471 |
| 70 | 100.497 | 4.263 |
| 71 | 102.560 | 1.581 |
| 72 | 104.097 | 3.609 |
| 73 | 106.390 | 5.219 |
| 74 | 107.490 | 1.015 |
| 75 | 108.351 | 2.461 |
| 76 | 112.123 | 4.115 |
| 77 | 112.430 | 1.581 |
| 78 | 113.994 | 3.154 |
| 79 | 117.360 | 1.015 |
| 80 | 117.390 | 5.219 |
| 81 | 118.563 | 2.388 |
| 82 | 119.553 | 4.017 |
| 83 | 122.300 | 1.581 |
| 84 | 123.779 | 3.337 |
| 85 | 126.137 | 4.256 |
| 86 | 126.669 | 2.352 |
| 87 | 127.230 | 1.015 |
| 88 | 127.580 | 5.219 |
| 89 | 131.116 | 3.769 |
| 90 | 132.170 | 1.581 |
| 91 | 133.752 | 2.846 |
| 92 | 136.696 | 2.075 |
| 93 | 136.960 | 5.219 |
| 94 | 137.100 | 1.015 |
| 95 | 137.424 | 4.387 |
| 96 | 140.348 | 2.779 |
| 97 | 141.096 | 3.760 |
| 98 | 142.040 | 1.581 |
| 99 | 145.436 | 4.405 |
| 100 | 145.520 | 5.219 |
| 101 | 146.970 | 1.015 |
| 102 | 147.941 | 2.604 |
| 103 | 149.654 | 3.648 |
| 104 | 151.839 | 4.399 |
| 105 | 151.910 | 1.874 |
| 106 | 153.190 | 1.015 |
| 107 | 154.080 | 5.219 |
| 108 | 158.089 | 4.054 |
| 109 | 158.699 | 3.026 |
| 110 | 160.140 | 1.015 |
| 111 | 161.050 | 1.874 |
| 112 | 163.460 | 5.219 |
| 113 | 164.354 | 3.560 |
| 114 | 166.409 | 2.715 |

TABLE NO. 2-continued

| NO | α° ± .02 | A ± .015 |
|---|---|---|
| 115 | 167.820 | 1.015 |
| 116 | 169.460 | 1.874 |
| 117 | 169.562 | 4.223 |
| 118 | 170.255 | 3.354 |
| 119 | 173.650 | 5.219 |
| 120 | 174.663 | 2.769 |
| 121 | 176.230 | 1.015 |
| 122 | 177.140 | 1.874 |
| 123 | 178.358 | 3.737 |
| 124 | 182.874 | 4.377 |
| 125 | 183.458 | 2.742 |
| 126 | 184.090 | 1.874 |
| 127 | 184.650 | 5.219 |
| 128 | 185.370 | 1.015 |
| 129 | 188.493 | 3.853 |
| 130 | 189.874 | 2.816 |
| 131 | 190.310 | 1.874 |
| 132 | 193.210 | 5.219 |
| 133 | 194.321 | 4.332 |
| 134 | 195.240 | 1.015 |
| 135 | 195.863 | 3.329 |
| 136 | 196.470 | 2.543 |
| 137 | 200.180 | 1.581 |
| 138 | 201.345 | 3.817 |
| 139 | 202.590 | 5.219 |
| 140 | 203.419 | 2.736 |
| 141 | 205.110 | 1.015 |
| 142 | 207.630 | 3.636 |
| 143 | 210.050 | 1.581 |
| 144 | 210.600 | 4.386 |
| 145 | 212.780 | 5.219 |
| 146 | 213.409 | 2.565 |
| 147 | 214.980 | 1.015 |
| 148 | 216.632 | 3.419 |
| 149 | 219.591 | 4.121 |
| 150 | 219.920 | 1.581 |
| 151 | 222.127 | 2.311 |
| 152 | 223.780 | 5.219 |
| 153 | 224.850 | 1.015 |
| 154 | 226.714 | 3.432 |
| 155 | 227.463 | 4.334 |
| 156 | 227.869 | 2.476 |
| 157 | 229.790 | 1.581 |
| 158 | 233.891 | 2.523 |
| 159 | 233.970 | 5.219 |
| 160 | 234.720 | 1.015 |
| 161 | 236.511 | 3.715 |
| 162 | 239.660 | 1.581 |
| 163 | 239.818 | 2.535 |
| 164 | 243.279 | 3.860 |
| 165 | 243.350 | 5.219 |
| 166 | 244.590 | 1.015 |
| 167 | 246.465 | 3.013 |
| 168 | 248.093 | 4.408 |
| 169 | 249.530 | 1.874 |
| 170 | 250.810 | 1.015 |
| 171 | 251.910 | 5.219 |
| 172 | 252.289 | 3.686 |
| 173 | 254.857 | 2.683 |
| 174 | 255.295 | 4.406 |
| 175 | 257.760 | 1.015 |
| 176 | 258.377 | 3.700 |
| 177 | 258.670 | 1.874 |
| 178 | 261.421 | 2.940 |
| 179 | 262.664 | 4.393 |
| 180 | 262.910 | 5.219 |
| 181 | 265.440 | 1.015 |
| 182 | 267.080 | 1.874 |
| 183 | 267.480 | 2.973 |
| 184 | 268.016 | 3.855 |
| 185 | 273.100 | 5.219 |
| 186 | 273.850 | 1.015 |
| 187 | 274.244 | 3.717 |
| 188 | 274.277 | 2.675 |
| 189 | 274.760 | 1.874 |
| 190 | 281.371 | 4.179 |
| 191 | 281.710 | 1.874 |
| 192 | 282.480 | 5.219 |
| 193 | 282.990 | 1.015 |
| 194 | 283.177 | 3.063 |
| 195 | 286.821 | 3.747 |

TABLE NO. 2-continued

| NO | α° ± .02 | A ± .015 |
|---|---|---|
| 196 | 287.930 | 1.874 |
| 197 | 290.555 | 2.745 |
| 198 | 291.040 | 5.219 |
| 199 | 291.477 | 4.276 |
| 200 | 292.860 | 1.015 |
| 201 | 296.741 | 2.788 |
| 202 | 297.799 | 3.720 |
| 203 | 297.800 | 1.581 |
| 204 | 299.600 | 5.219 |
| 205 | 301.114 | 4.381 |
| 206 | 302.730 | 1.015 |
| 207 | 303.543 | 2.273 |
| 208 | 303.757 | 3.214 |
| 209 | 307.670 | 1.581 |
| 210 | 308.371 | 3.979 |
| 211 | 308.980 | 5.219 |
| 212 | 312.392 | 2.173 |
| 213 | 312.600 | 1.015 |
| 214 | 312.906 | 2.968 |
| 215 | 316.496 | 3.797 |
| 216 | 317.540 | 1.581 |
| 217 | 319.041 | 2.857 |
| 218 | 319.170 | 5.219 |
| 219 | 322.470 | 1.015 |
| 220 | 322.952 | 4.062 |
| 221 | 324.449 | 2.407 |
| 222 | 326.388 | 3.367 |
| 223 | 327.410 | 1.581 |
| 224 | 330.170 | 5.219 |
| 225 | 330.372 | 4.017 |
| 226 | 331.195 | 2.408 |
| 227 | 332.340 | 1.015 |
| 228 | 332.482 | 3.191 |
| 229 | 336.164 | 4.354 |
| 230 | 337.280 | 1.581 |
| 231 | 338.333 | 2.672 |
| 232 | 338.730 | 5.219 |
| 233 | 339.483 | 3.491 |
| 234 | 342.210 | 1.015 |
| 235 | 342.237 | 2.015 |
| 236 | 342.684 | 4.163 |
| 237 | 346.008 | 2.690 |
| 238 | 346.570 | 3.544 |
| 239 | 347.150 | 1.581 |
| 240 | 348.110 | 5.219 |
| 241 | 349.690 | 4.307 |
| 242 | 352.080 | 1.015 |
| 243 | 353.573 | 1.847 |
| 244 | 355.114 | 3.010 |
| 245 | 357.263 | 3.856 |
| 246 | 358.741 | 2.381 |

We claim:

1. For an earth boring drill bit, an improved cutter comprising:

a cutter shell rotatably mounted on the drill bit; and a cutting structure on the shell comprising a plurality of cutting elements, a selected region of the cutting structure having a pattern wherein all of the cutting elements are dispersed therein substantially free of all types of rows.

2. For an earth boring drill bit, an improved cutter comprising:

a cutter shell rotatably mounted on the drill bit; and a cutting structure on the shell comprising a plurality of cutting elements protruding from the shell, a selected region of the cutting structure having a pattern wherein all of the cutting elements are dispersed within boundary zone limits at different distances from each other and at different distances from an edge of the cutter to eliminate rows.

3. For an earth boring drill bit, an improved cutter comprising:

a cutter shell rotatably mounted on the drill bit; and a plurality of cutting elements protruding from the shell for disintegrating the earth, the cutting elements in a selected region of the cutter shell being dispersed such that all of the cutting elements are identifiable in groups of three adjacent cutting elements which are located relative to each other in a spacing that differs from the spacings of all of the other groups.

4. For an earth boring drill bit, an improved cutcomprising:

a cutter shell rotatably mounted on the drill bit, the shell having a nose region on its inner side and a gage region on its outer side separated by an intermediate region;

a circumferential heel row of inserts located in the intermediate region next to the gage region, the pitch between heel row inserts differing at some points than at others;

first and second staggered rows of inserts located in the intermediate region next to the heel row inserts, with the second staggered row being located farther from the heel row than the first row by an amount less than the diameter of any of the inserts of the first and second staggered rows;

the first and second staggered rows of inserts being positioned in groups containing a plurality of inserts, the groups of each row being circumferentially spaced apart and alternated so that a group of the second staggered row follows a group of the first staggered row; and a plurality of irregularly located inserts positioned in the intermediate region bounded on the outer side by the first and second staggered rows of inserts, each insert in the intermediate region having a surrounding boundary zone with minimum and maximum distances between centerlines of any two inserts;

substanitally all of the irregularly located inserts being randomly located within one of the boundary zones of another of the irregularly located inserts.

5. An earth boring drill bit comprised in combination:

a cutter support member adapted to be connected to a string of drill pipe for imparting rotary drive to the cutter support member;

at least one inner cutter rotatably rotatably mounted to the cutter support member adjacent the center for disintegrating the earth formation face in the vicinity of the center;

a plurality of gage cutters rotatably mounted at the periphery of the cutter support member for disintegrating the earth formation face in the gage vicinity; and a plurality of intermediate cutters rotatably mounted to the cutter support member between the inner cutter and the gage cutters at regular intervals for disintegrating the earth formation face in the vicinity between the center and the gage areas;

the intermediate cutters having an insert pattern wherein the inserts are dispersed within boundary zone limits to eliminate rows;

the gage cutter having a nose region and a gage region separated by an intermediate region, and an insert pattern of hard metal inserts comprising:

first and second staggered rows of inserts located in the intermediate region; the first and second staggered rows being positioned in groups of at least one insert, the groups of each staggered row being circumferentially spaced apart and alternated so that a group of the second staggered row follows a group of the first staggered row; and a plurality of irregularly located inserts positioned in the intermediate region bounded on one side by the first and second staggered rows, each irregularly located insert being dispersed within boundary zone limits to eliminate rows.

6. For an earth boring drill bit of the type having a cutter shell rotatably mounted on the drill bit, and a plurality of cutting elements protruding from the shell for disintegrating the earth formation, an improved method of locating the cutting elements in a selected region, comprising:

defining for each cutting element to be in the selected region a surrounding boundary zone that has an inner boundary corresponding to the minimum desired distance between cutting elements, and an outer boundary corresponding to the maximum desired distance between cutting elements;

arbitrarily selecting the location of a first cutting element;

randomly selecting the location of a second cutting element within the first cutting element's boundary zone, and outside the inner boundary of the first cutting element; then randomly selecting the location of each succeeding cutting element within the boundary zone of the preceding cutting element and outside the inner boundaries of the preceding cutting elements.

7. In an earth boring bit having a cutter shell rotatably mounted on the bit, the shell having a gage region on its outer side and an intermediate region joining the gage region and extending inwardly, an improved cutting structure containing earth disintegrating cutting elements protruding from the shell comprising in combination:

a circumferential heel row of the cutting elements located in the intermediate region next to the gage region; and a plurality of the cutting elements dispersed on the intermediate region inward of the heel row in a pattern wherein all of the cutting elements are dispersed therein substantially free of all types of rows in the pattern.

8. For an earth boring drill bit, an improved cutter comprising:

a cutter shell rotatably mounted on the drill bit, the shell having a nose region on its inner side, and a gage region on its outer side separated by an intermediate region;

a circumferential row of cutting elements located in the intermediate region next to the gage region;

a circumferential row of cutting elements located in the nose region; and a plurality of cutting elements dispersed in a pattern between the rows that is substantially free of any rows.

* * * * *